US011717061B2

(12) United States Patent
Pferdehirt

(10) Patent No.: US 11,717,061 B2
(45) Date of Patent: Aug. 8, 2023

(54) MALE MEMBER OF SNAP FASTENER AND SNAP FASTENER

(71) Applicant: YKK CORPORATION, Tokyo (JP)

(72) Inventor: Thomas Pferdehirt, Wuppertal (DE)

(73) Assignee: YKK CORPORATION

( * ) Notice: Subject to any disclaimer, the term of this patent is extended or adjusted under 35 U.S.C. 154(b) by 0 days.

(21) Appl. No.: 17/355,344

(22) Filed: Jun. 23, 2021

(65) Prior Publication Data

US 2021/0315326 A1 Oct. 14, 2021

Related U.S. Application Data

(62) Division of application No. 16/345,090, filed as application No. PCT/JP2017/038703 on Oct. 26, 2017, now Pat. No. 11,064,772.

(30) Foreign Application Priority Data

Oct. 28, 2016 (DE) ..... 102016012899.2
Oct. 28, 2016 (DE) ..... 102016012901.8

(51) Int. Cl.
*A44B 17/00* (2006.01)

(52) U.S. Cl.
CPC ..... *A44B 17/007* (2013.01); *A44B 17/00* (2013.01); *A44B 17/0029* (2013.01); *A44B 17/0041* (2013.01)

(58) Field of Classification Search
CPC ... A44B 17/007; A44B 17/00; A44B 17/0029; A44B 17/0041; Y10T 24/1959; Y10T 24/3424; Y10T 24/45047; Y10T 24/45099; Y10T 24/45105; Y10T 24/45178; Y10T 24/45257
See application file for complete search history.

(56) References Cited

U.S. PATENT DOCUMENTS

| | | | |
|---|---|---|---|
| 2,986,790 | A | 6/1961 | Silver et al. |
| 4,577,376 | A | 3/1986 | Clendinen |
| 11,064,772 | B2 | 7/2021 | Pferdehirt |
| 2003/0200633 | A1 | 10/2003 | Kimoto et al. |

(Continued)

FOREIGN PATENT DOCUMENTS

| | | |
|---|---|---|
| DE | 19547278 | 7/1996 |
| GB | 659336 | 10/1951 |

(Continued)

OTHER PUBLICATIONS

English Translation of H09094107 as produced by j-platpat.inpit.go.jp (Year: 2022).*

(Continued)

*Primary Examiner* — Robert Sandy
*Assistant Examiner* — Michael S Lee
(74) *Attorney, Agent, or Firm* — Taylor English Duma LLP

(57) ABSTRACT

This male member of a snap fastener is provided with a first portion and a second portion, wherein the first portion is composed of a plastic material, and the second portion is composed of a metal portion. In addition, the male member of the snap fastener has an engaging protrusion part working together with an eyelet of a female member, and a cover which at least partially covers the engaging protrusion part is provided to a side of the male member, the side facing the female member.

9 Claims, 6 Drawing Sheets

(56) References Cited

U.S. PATENT DOCUMENTS

| | | | |
|---|---|---|---|
| 2012/0066874 | A1 | 3/2012 | Lecompte et al. |
| 2019/0281931 | A1 | 9/2019 | Pferdehirt |

FOREIGN PATENT DOCUMENTS

| | | |
|---|---|---|
| JP | S59-166714 | 11/1984 |
| JP | H08024010 | 1/1996 |
| JP | 08182510 | 7/1996 |
| JP | H08182510 | 7/1996 |
| JP | H09094107 | 4/1997 |
| JP | 2012063010 | 3/2012 |
| KR | 20100007632 | 1/2010 |
| WO | 2018079654 | 5/2018 |

OTHER PUBLICATIONS

Pferdehirt, Thomas; Final Office Action for U.S. Appl. No. 16/345,090, filed Apr. 25, 2019, dated Nov. 30, 2020, 16 pgs.

Pferdehirt, Thomas; International Preliminary Report on Patentability for PCT/JP2017/038703, filed Oct. 26, 2017, dated Apr. 30, 2019, 18 pgs.

Pferdehirt, Thomas; International Search Report and Written Opinion for PCT/JP2017/038703, filed Oct. 26, 2017, dated Dec. 19, 2017, 22 pgs.

Pferdehirt, Thomas; Non-Final Office Action for U.S. Appl. No. 16/345,090, filed Apr. 25, 2019, dated Jun. 25, 2020, 16 pgs.

Pferdehirt, Thomas; Notice of Allowance for U.S. Appl. No. 16/345,090, filed Apr. 25, 2019, dated Mar. 22, 2021, 10 pgs.

Pferdehirt, Thomas; Requirement for Restriction/Election for U.S. Appl. No. 16/345,090, filed Apr. 25, 2020, dated Feb. 28, 2020, 6 pgs.

YKK Corporation; Extended European Search Report for application No. 17866319.1, dated Jun. 5, 2020, 6 pgs.

YKK Corporation; Office Action for German patent application No. 10 2016 012 899.2, dated Nov. 12, 2019, 6 pgs.

* cited by examiner

MALE MEMBER OF SNAP FASTENER AND SNAP FASTENER

REFERENCE TO RELATED APPLICATIONS

This application is a divisional of U.S. application Ser. No. 16/345,090, filed Apr. 25, 2019, which is hereby specifically incorporated by reference herein in its entirety.

TECHNICAL FIELD

The present invention relates to a male member of a snap fastener.

BACKGROUND ART

Related male members of snap fasteners are made of a single material, and in most cases are made of plastics or metals. However, male members of snap fasteners must perform various functions, particularly withstand various influences during use and washing. The related male members of snap fasteners do not satisfy many of these requirements.

Patent Document 1 described below is known as a related male member of a snap fastener.

In the male member described in Patent Document 1 described below, since a engagement protruding portion extends in a direction of a main shaft of the snap fastener, an end surface of the engagement protruding portion may be damaged when the snap fastener is not engaged. Since a surface of the engagement protruding portion is likely to be damaged, the engagement protruding portion of the male member in the related art is scratched or deformed after a certain period of use. Further, design possibilities of the engagement protruding portion of the male member in the related art are limited due to functional requirements. Therefore, it is difficult to achieve an attractive appearance of the male member.

PRIOR ART DOCUMENT

Patent Document

Patent Document 1: US2003/0200633

SUMMARY OF THE INVENTION

Problems to be Solved by the Invention

Therefore, a first object of the present invention is to improve a male member of a snap fastener so as to satisfy the above many requirements simultaneously, particularly to protect the male member from damages. A second object of the present invention is to solve the above-described problems, particularly to protect the engagement protruding portion from damages, and further to improve a visual appearance of the male member.

Means for Solving Problems

The first object of the present invention is achieved by following configuration.

A male member of a snap fastener is made of at least two materials: a plastic material such as acrylonitrile butadiene styrene (ABS), polyamide (PA), and/or polyoxymethylene (POM), and a metallic material such as aluminum, brass, and/or (stainless) steel.

A combination of the materials provides more options compared to related male member made of single material so that it is possible to simultaneously meet various requirements.

Preferably, the male member includes at least two portions in which a first portion is made of the plastic material and a second portion is made of the metallic material. For example, a part of the male member having a complicated shape may be made of a plastic material, and a part of the male member required to have high damage resistance may be made of a metallic material.

According to a further preferred embodiment of the present invention, the first portion includes an engagement protruding portion that cooperates with an eyelet of a female member of the snap fastener. The engagement protruding portion must meet several requirements and should have a shape that is optimal for snap engagement. Manufacture of the first portion based on a plastic material is easier compared to manufacture of the first portion based on a metallic material. Specifically, the first portion can be manufactured by injection molding.

The engagement protruding portion preferably has flexibility. As a result, it is possible to improve snap engagement procedure and close the snap fastener easily.

Specifically, the engagement protruding portion preferably can elastically be deformed so as to expand. Accordingly, the engagement protruding portion is at least partially moved inward to simplify the snap engagement procedure.

The second portion is preferably disposed between the first portion and holding unit that holds the male member on a support. Thus, the second portion can protect the first portion from damages resulting from direct abutment of the holding unit against the first portion.

In order to enhance stability, the second portion is preferably sandwiched between the holding unit and the first portion.

The holding unit is a rivet. This is a simple and inexpensive method for attaching the male member to the support.

According to a further preferred embodiment of the present invention, the second portion has a ring-like washer shape. Since the ring-like washer shape is very simple, it is easy to manufacture.

The present invention also relates to a snap fastener including the male member and the counterpart female member of the male member, in addition to the male member. The ring-like curved wall of the female member that forms the eyelet into which the engagement protruding portion of the male member is inserted has no flexibility. The reason for this is that it is extremely easy and inexpensive to manufacture each of the walls that forms the eyelet.

Finally, the wall is preferably made of a metallic material. Also, the manufacture of the wall based on metal is easy and inexpensive.

The second object of the present invention is achieved by following configuration.

The male member of the snap fastener, which includes an engagement protruding portion that cooperates with an eyelet of a female member of the snap fastener, is provided with a cover at least partially covering the engagement protruding portion on a side facing the female member when the male member is engaged with the female member.

In other words, the cover is a type of shield that protects the engagement protruding portion from damages, particularly damages from environment and use. In addition, the cover may be used to improve the visual appearance.

The engagement protruding portion can be made of any suitable material, but the engagement protruding portion is preferably made of a plastic material such as acrylonitrile butadiene styrene (ABS), polyamide (PA), and/or polyoxymethylene (POM).

According to the preferred embodiment, the cover is made of a metal or metal alloy, such as aluminum, brass, and/or (stainless) steel. The use of metal has several advantages. A metal is less susceptible to be damaged than a plastic material, particularly for mechanical damages such as scratch. Further, it is easy to achieve an attractive appearance of a metal surface.

According to the further preferred embodiment of the present invention, a gap exists between an end surface of the engagement protruding portion and the cover. As a result, the engagement protruding portion can move during snap engagement without being hindered by the cover. Specifically, the movement of the engagement protruding portion during snap engagement is a radial inward movement.

The cover may be held so as to abut against an end surface of the base. In other words, the base that may be additionally provided is used to hold the cover in place. Thus, the cover can at least partially cover the engagement protruding portion on the side facing the female member when the male member is engaged with the female member to protect the engagement protruding portion. Further, the cover may be held with a gap between the end surface of the engagement protruding portion and the cover.

According to the further preferred embodiment of the present invention, at least one of the engagement protruding portion and the base is provided in a sleeve shape. In other words, at least one of the engagement protruding portion and the base is provided in a ring shape as viewed from the side facing the female member when the male member is engaged with the female member. Each design is easily achieved by, for example, injection molding.

Preferably, the engagement protruding portion is concentrically disposed around the base. In other words, for example, there are two sleeves disposed concentrically with each other.

According to the further preferred embodiment of the present invention, a space into which the engagement protruding portion moves inward at a time of snap engagement with the female member is provided. The space is at least partially covered by the cover. As a result, in case of a concentric sleeve, for example, a ring-shaped space is protected by the cover, so that any foreign matter is prevented from falling into the space and hindering snap engagement. In addition, the space is not visible at least as long as the space is covered by the cover, so that the visual appearance is improved.

According to the present invention, as viewed from the side facing the female member when the male member is engaged with the female member, the space is arranged between the base and the engagement protruding portion. The design is easily achieved by, for example, injection molding.

According to the further preferred embodiment of the present invention, a holding unit that holds the male member on a support abuts against the cover at the side facing the female member when the male member is engaged with the female member. Thus, the holding unit has two functions of holding the male member on the support and holding the cover. The support may be any material to which the snap fastener is fixed, such as a fibrous material and a leather material.

The cover may include at least one blocking unit used to prevent movement of the male member in a lateral direction with respect to an engaging direction. Thus, the cover has two functions. That is, the cover serves to cover or protect the engagement protruding portion, and serves to prevent movement of the male member in the lateral direction with respect to the engaging direction to fix the male member to the support.

The cover may include an outer flange disposed outward and an inner flange disposed inward. The cover may have a sleeve shape or a hollow cylindrical shape such as a pipe shape. Thus, the outer flange has a function of covering or protecting the engagement protruding portion. The inner flange serves as an abutting portion of the holding unit to fix the male member on the support. The side wall of the sleeve serves as the blocking unit used to prevent movement of the male member in the lateral direction with respect to the engagement direction.

The present invention also relates to a snap fastener including the male member.

Preferably, a wall that forms the eyelet of the female is made of a metallic material such as aluminum, brass, and/or steel (stainless steel).

Hereinafter, the present invention is described in further detail using preferred exemplary embodiments with reference to the accompanying drawings.

DESCRIPTION OF EMBODIMENTS

First Embodiment

First, a first embodiment of a male member of a snap fastener according to the present invention and a snap fastener including the male member are described with reference to FIGS. 1 to 3.

Figure 1:
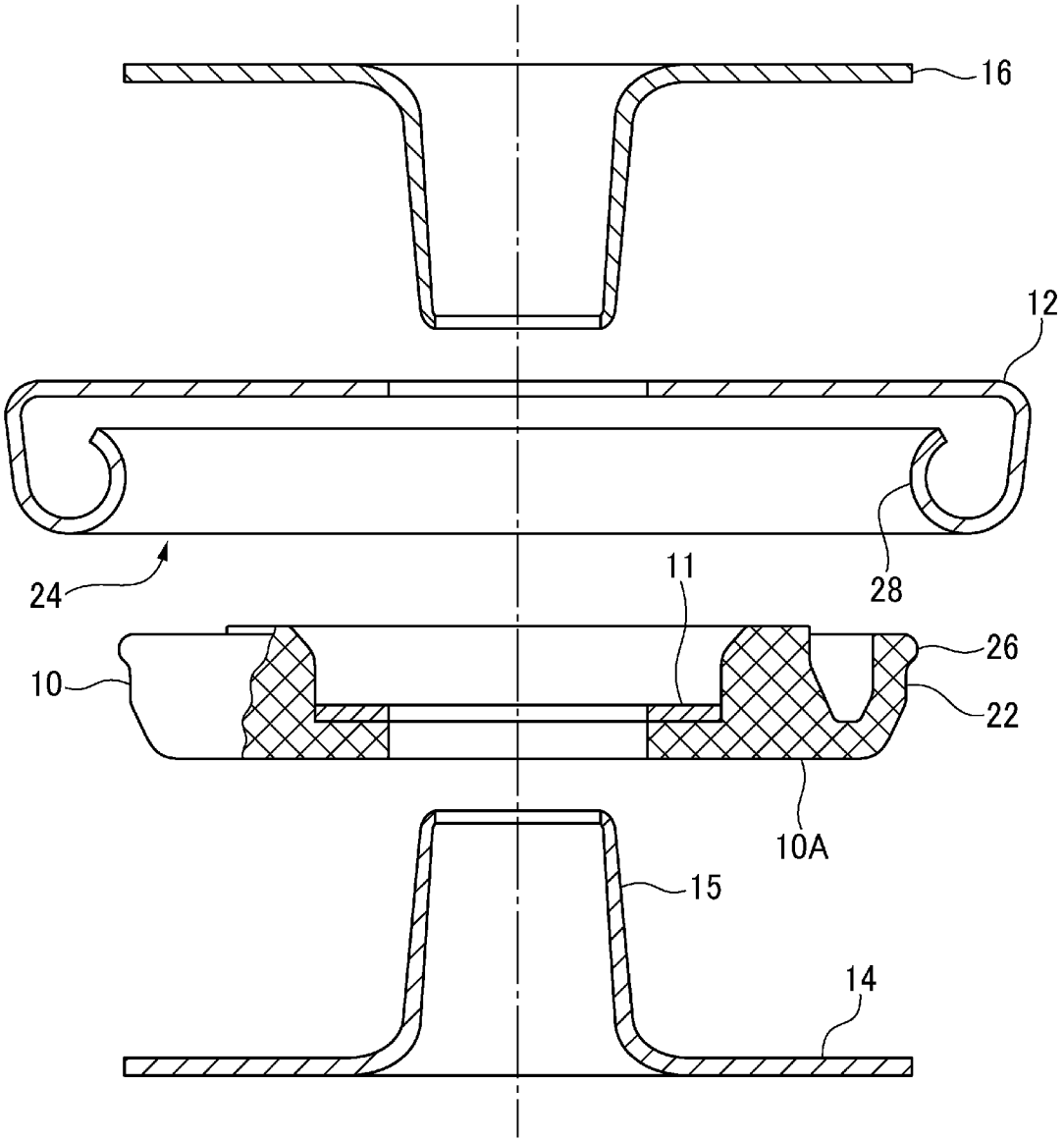
FIG. 1 is an exploded cross-sectional view of a snap fastener including a male member according to a first embodiment of the present invention.
Figure 2:
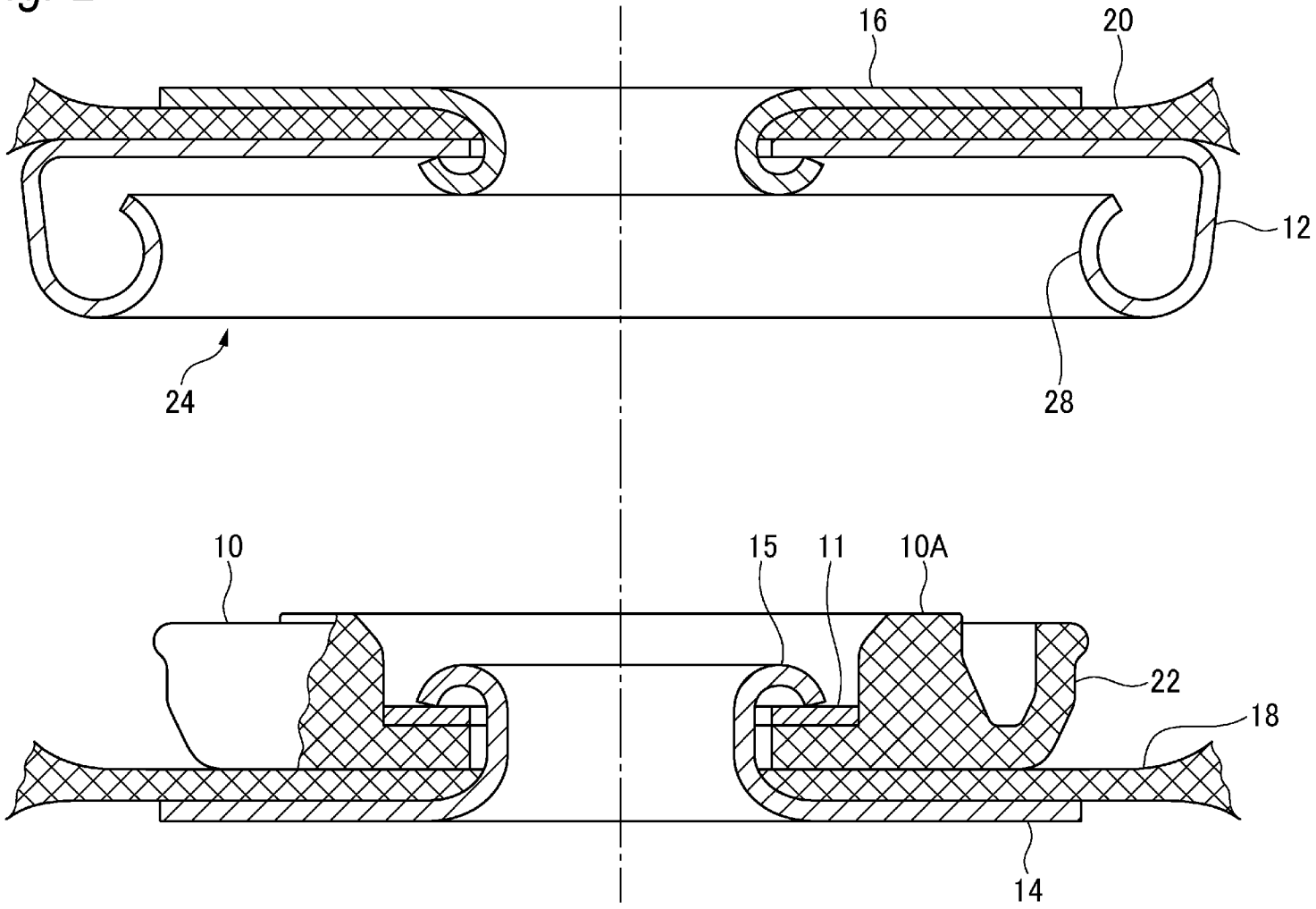
FIG. 2 is a cross-sectional view illustrating an open state of the snap fastener in FIG. 1 attached to a fabric.
Figure 3:
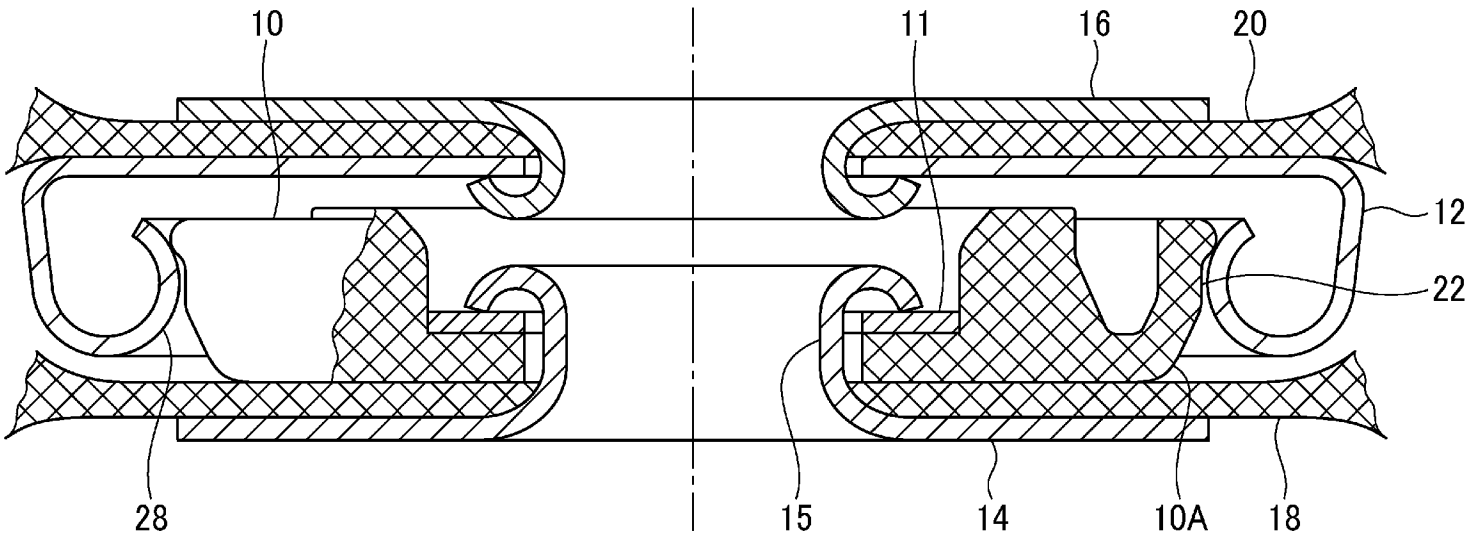
FIG. 3 is a cross-sectional view of the snap fastener in FIG. 2 in a closed state.

The snap fastener illustrated in FIGS. 1 to 3 includes a male member 10 and a female member 12 as a counterpart of the male member 10. The male member 10 includes a main body (a first portion) 10A and a cover (a second portion) 11. The main body 10A is made of a plastic material such as polyoxymethylene (POM). The cover 11 and the female member 12 are made of a metallic material such as brass. The snap fastener includes rivets (holding units) 14, 16 used to attach the male member 10 and the female member 12 to fabrics (supports) 18, 20, respectively.

The main body 10A of the male member 10 includes an engagement protruding portion 22 that cooperates with an eyelet 24 of the female member 12. The engagement protruding portion 22 has a sleeve shape and includes a bulging portion 26 on an outer surface in a radial direction. The bulging portion 26 cooperates with a wall 28 that forms the eyelet 24 for snap engagement of the male member 10 and the female member 12. Further, the engagement projection 22 has flexibility and can elastically expand and deform.

The cover 11 serves to attach the main body 10A to the fabric 18 since a rivet shaft portion 15 of the rivet 14 abuts against the cover 11 and the cover 11 abuts against the main body 10A of the male member 10. In other words, the cover 11 is sandwiched between the rivet shaft portion 15 and the main body 10A. Thus, since the rivet shaft portion 15 does not directly abut against the main body 10A, it is possible to prevent the main body 10A from damages due to the abutment of the rivet shaft portion 15.

Since the cover 11 is made of a metallic material, it is less susceptible to be damaged than a plastic material, particularly for mechanical damages such as scratches that may occur during use and washing. Therefore, the main body 10A of the male member 10 can be protected from being damaged by the cover 11.

The cover 11 may be supplied as a separate component or may be fixed to the main body 10A of the male member 10 by, for example, bonding and welding.

Since the main body 10A of the male member 10 is made of a plastic material, the engagement protruding portion 22 of the main body 10A is easily moved radially inward, particularly during snap engagement. Further, it is easy to provide the bulging portion 26 on the engagement protruding portion 22 by the injection molding process.

Further, in the present embodiment, since the cover 11 has a ring-like washer shape, it is easy to manufacture the cover 11.

Further, since the main body 10A of the male member 10 can have sufficient flexibility to ensure an easy snap engagement procedure, the female member 12 does not need to have flexibility for the snap engagement procedure. Therefore, it is easy to manufacture the female member 12.

As illustrated in FIGS. 2 and 3, the snap fastener in the present embodiment has an extremely flat structure since attachment of a snap is performed at an edge of the snap rather than a center of the snap. Thus, there is no need to provide, in height of the snap, space for both snap operation and attachment of the male member and the female member to each piece of material made in the same area as the snap operation.

Finally, it should be noted that the rivets 14, 16 are attachment units but not parts or members of the snap fastener.

Features of the present invention disclosed in the above specification, claims, and drawings may be essential to realization of the present invention in various individual embodiments and any combination of these embodiments.

Second Embodiment

First, a second embodiment of a male member of a snap fastener according to the present invention and a snap fastener including the male member are described with reference to FIGS. 4 to 6.

Figure 4:
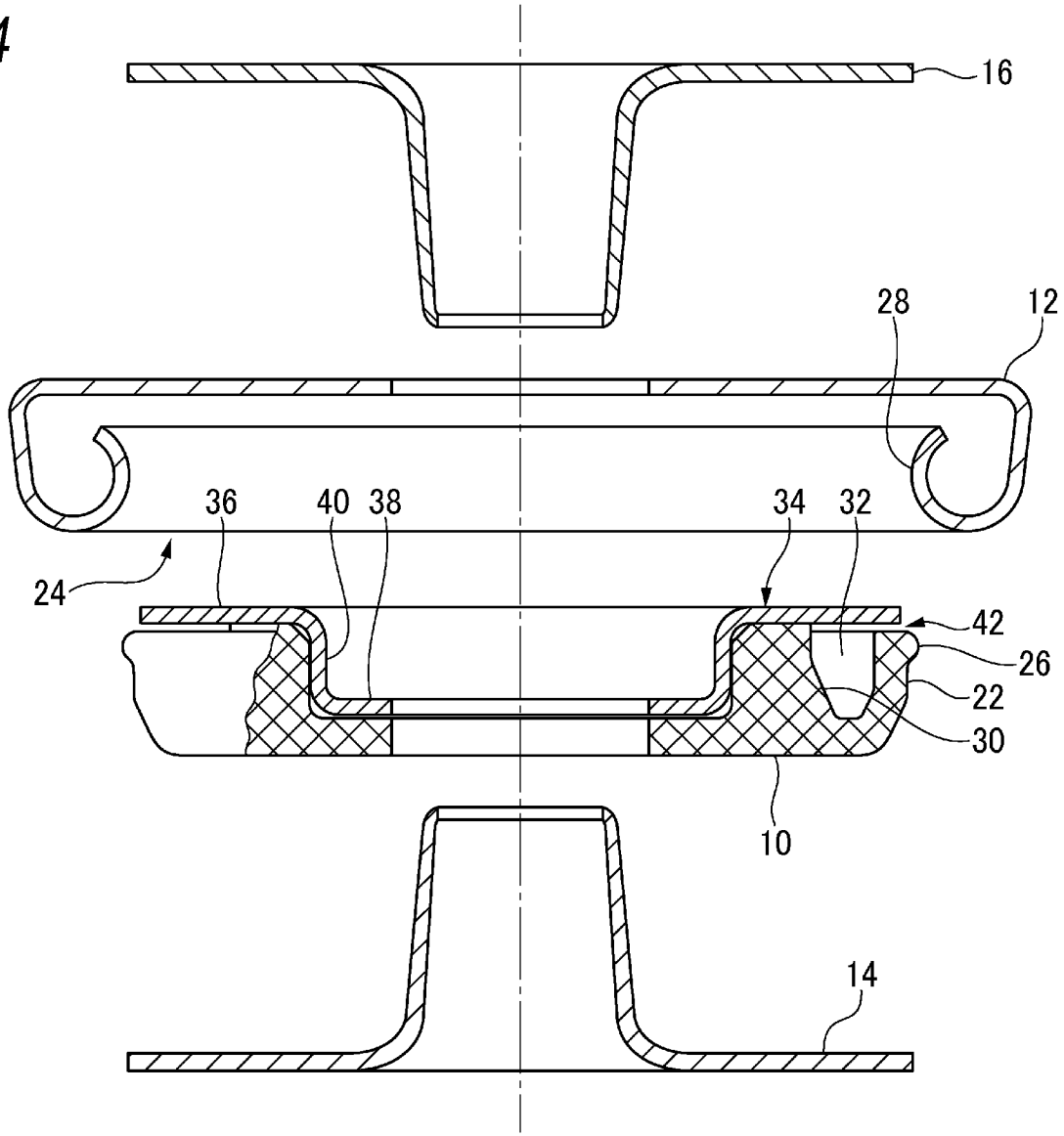
FIG. 4 is an exploded cross-sectional view of a snap fastener including a male member according to a second embodiment of the present invention.
Figure 5:
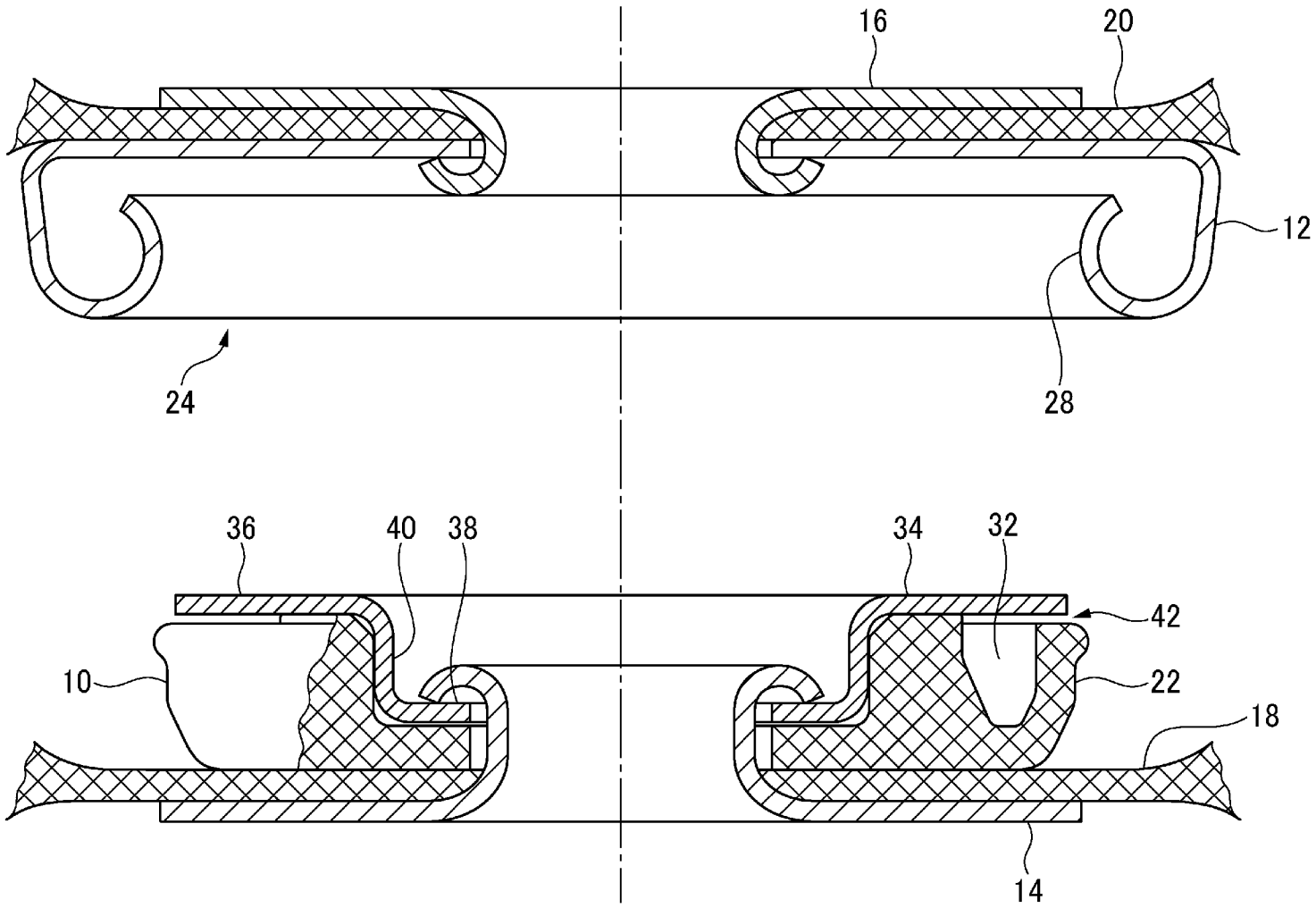
FIG. 5 is a cross-sectional view illustrating an open state of the snap fastener in FIG. 4 attached to a fabric.
Figure 6:
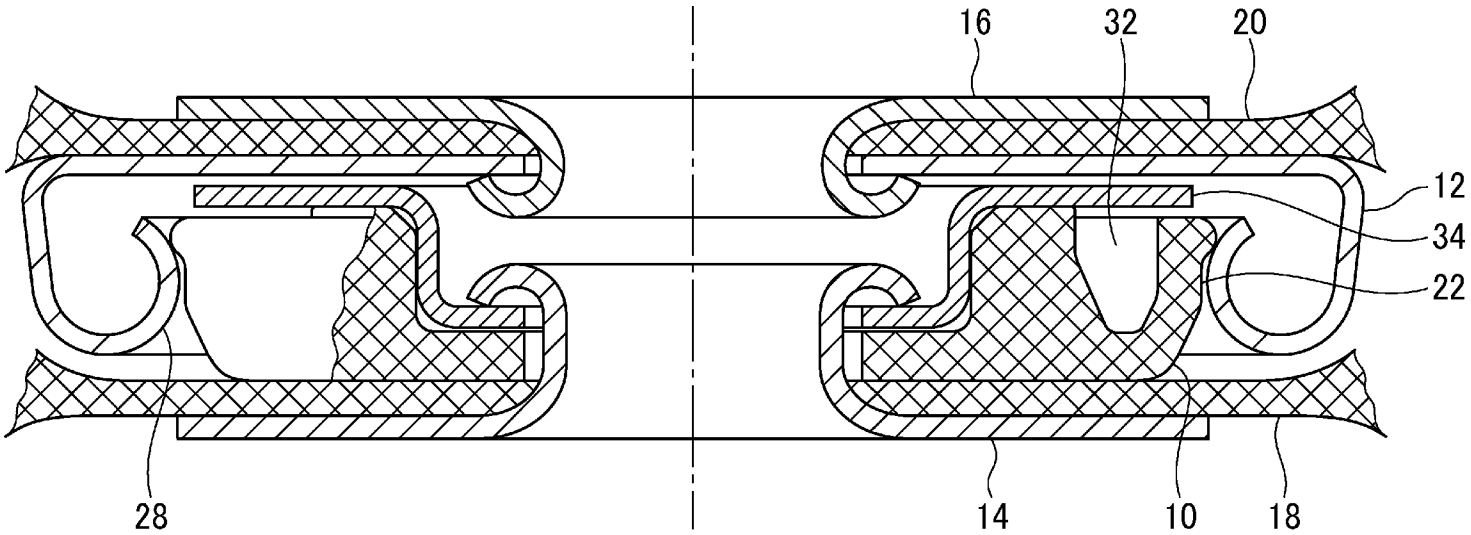
FIG. 6 is a cross-sectional view of the snap fastener in FIG. 5 in a closed state.

The snap fastener illustrated in FIGS. 4 to 6 includes the male member 10 and the counterpart female member 12 of the male member 10. The male member 10 of the present embodiment is made of a plastic material such as polyoxymethylene (POM). The female member 12 of the present embodiment is made of a metal such as aluminum, brass, and steel (stainless steel), or a metal alloy. The snap fastener includes the rivets (the holding units) 14, 16 used to attach the male member 10 and the female member 12 to the fabrics (the supports) 18, 20, respectively.

The male member 10 includes an engagement protruding portion 22 that cooperates with the eyelet 24 of the female member 12. The engagement protruding portion 22 is provided in a sleeve shape or a hollow cylindrical shape such as a pipe shape, and includes the bulging portion 26 on an outer surface in a radial direction. The bulging portion 26 cooperates with the ring-shaped curved wall 28 that forms the eyelet 24 for snap engagement of the male member 10 and the female member 12.

The male member 10 includes a base 30 formed in a sleeve shape. The engagement protruding portion 22 is concentrically disposed around the base 30. Further, as viewed from a side facing the female member 12, a ring-shaped space 32 is arranged between the base 30 and the engagement protruding portion 22. The space 32 is provided so that the engagement protruding portion 22 is movable radially inward at a time of snap engagement with the female member 12.

The male member 10 is provided with a cover 34 at least partially covering the engagement protruding portion 22 on the side facing the female member 12 when the male member 10 is engaged with the female member 12. The cover 34 includes an outer flange 36 disposed radially outward, an inner flange 38 disposed radially inward, and a side wall 40 axially connecting the outer flange 36 and the inner flange 38. The cover 34 is formed in a sleeve shape. The cover 34 may have a hollow cylindrical shape such as a pipe shape.

The outer flange 36 of the cover 34 is held so as to abut against one axial end surface (an upper end surface in FIG. 4) of the base 30. Further, the outer flange 36 is expanded radially outward beyond the space 32 to at least partially cover the engagement protruding portion 22. A gap 42 is provided between the outer flange 36 and one axial end surface (an upper end surface in FIG. 4) of the engagement protruding portion 22. Accordingly, the outer flange 36 and the engagement protruding portion 22 are not in direct contact with each other. The gap 42 is caused due to the matter that the base 30 is formed higher than the engagement protruding portion 22. Accordingly, the outer flange 36 of the cover 34 does not interfere or prevent movement of the engagement protruding portion 22 during snap engagement. The movement of the engagement protruding portion 22 during snap engagement is a radial inward movement.

The rivet 14 abuts against the inner flange 38 of the cover 34 on the side facing the female member 12. The inner flange 38 abuts against a radially inner part of the male member 10. Thus, the inner flange 38 serves to attach the male member 10 to the fabric 18. Since the inner flange 38 is disposed between the rivet 14 and the male member 10 so that the rivet 14 does not directly abut against the male member 10, it is possible to prevent the radially inner part of the male member 10 from damages due to the abutment of the rivet 14.

The side wall 40 of the cover 34 is provided in a sleeve shape. Radially outer circumferential surface of the side wall 40 abuts against the base 30 of the male member 10. The side wall 40 functions as a blocking unit used to prevent movement of the male member in a lateral direction with respect to an engaging direction by abutting against the base 30, and the side wall 40 serves to fix the male member 10 to the fabric 18.

The cover 34 of the present embodiment is made of a metal such as aluminum, brass, and steel (stainless steel) or a metal alloy. Therefore, it is less susceptible to be damaged than a plastic material, particularly for mechanical damages such as scratches that may occur during use and washing.

Therefore, the male member 10 including the base 30, and particularly the engagement protruding portion 22, can be protected from being damaged by the cover 34.

Further, the cover 34 covers an upper part of the space 32 of the male member 10 to protect the space 32. As a result, it is possible to prevent any foreign matter from falling into the space 32, thereby preventing snap engagement of the engagement protruding portion 22 from being hindered.

In addition, the metallic cover 34 contributes to achieving an attractive appearance of the snap fastener. Since it is easy to apply each decorative element to a metal surface, design, logo, and other aesthetic feature can be easily assembled on the cover 34. Further, since the space 32 is covered by the cover 34 and cannot be seen, visual appearances of the male member 10 and the snap fastener can be improved.

The cover 34 may be supplied as a separate component or may be fixed to the male member 10 by, for example, bonding and welding.

The snap fastener illustrated in the figures has a circular profile in a top view and a bottom view.

As illustrated in FIGS. 5 and 6, the snap fastener in the present embodiment has an extremely flat structure since attachment of a snap is performed at an edge of the snap rather than a center of the snap. Thus, there is no need to provide, in height of the snap, space for both snap operation and attachment of the male member and the female member to each piece of material made in the same area as the snap operation.

Finally, it should be noted that the rivets 14, 16 are attachment units and not parts or members of the snap fastener.

Features of the present invention disclosed in the above specification, claims, and drawings may be integral to realizations of the present invention in various embodiments individually as well as in any combination.

The present application is based on German Federal Communications Patent Application (102016012899.2) filed on Oct. 28, 2016, and German Federal Communications Patent Application (102016012901.8) filed on Oct. 28, 2016, contents of which are incorporated herein by reference.

| DESCRIPTION OF REFERENCE NUMERALS | |
|---|---|
| (First Embodiment) | |
| 10 | male member |
| 10 | main body (first portion) |
| 11 | cover (second portion) |
| 12 | female member |
| 14, 16 | rivet (holding unit) |
| 15 | rivet shaft portion |
| 18, 20 | fabric (support) |
| 22 | engagement protruding portion |
| 24 | eyelet |
| 26 | bulging portion |
| 28 | wall |
| (Second Embodiment) | |
| 10 | male member |
| 12 | female member |
| 14, 16 | rivet (holding unit) |

-continued

| DESCRIPTION OF REFERENCE NUMERALS | |
|---|---|
| 18, 20 | fabric (support) |
| 22 | engagement protruding portion |
| 24 | eyelet |
| 26 | bulging portion |
| 28 | curved wall |
| 30 | base |
| 32 | space |
| 34 | cover |
| 36 | outer flange |
| 38 | inner flange |
| 40 | side wall (blocking unit) |
| 42 | gap |

The invention claimed is:

1. A male member of a snap fastener, the male member comprising:

a first portion made of a plastic material; and a second portion made of a metallic material and having a ring-like washer shape and defining a through hole;

wherein the second portion is configured to be disposed between the first portion and a holding unit that is configured to hold the male member on a support, and wherein the holding unit is configured to contact a side of the second portion, the side facing a female member of the snap fastener when the male member is engaged with the female member.

2. The male member of the snap fastener according to claim 1, wherein the first portion includes an engagement protruding portion that cooperates with an eyelet of the female member of the snap fastener.

3. The male member of the snap fastener according to claim 2, wherein the engagement protruding portion has flexibility.

4. The male member of the snap fastener according to claim 2, wherein the engagement protruding portion is configured to be deformed so as to expand.

5. The male member of the snap fastener according to claim 1, wherein the second portion is sandwiched between the holding unit and the first portion.

6. The male member of the snap fastener according to claim 1, wherein the holding unit is a rivet.

7. A snap fastener including the male member according to claim 1 and the female member as a counterpart of the male member, wherein a wall of the female member that forms an eyelet into which an engagement protruding portion of the male member is inserted has no flexibility.

8. The snap fastener according to claim 7, wherein the wall is made of a metallic material.

9. The male member of the snap fastener according to claim 1, wherein a material forming the second portion defines a constant thickness.

* * * * *